US011014115B2

(12) United States Patent
Huang et al.

(10) Patent No.: US 11,014,115 B2
(45) Date of Patent: May 25, 2021

(54) SHOWERHEAD CAPABLE OF DISCHARGING RESIDUAL WATER

(71) Applicant: XIAMEN SOLEX HIGH-TECH INDUSTRIES CO., LTD., Xiamen (CN)

(72) Inventors: Xi Huang, Xiamen (CN); Donghai Chen, Xiamen (CN); Mingfu Zhang, Xiamen (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 45 days.

(21) Appl. No.: 16/346,388

(22) PCT Filed: Mar. 30, 2017

(86) PCT No.: PCT/CN2017/078719
§ 371 (c)(1),
(2) Date: Apr. 30, 2019

(87) PCT Pub. No.: WO2018/113129
PCT Pub. Date: Jun. 28, 2018

(65) Prior Publication Data

US 2019/0255552 A1 Aug. 22, 2019

(30) Foreign Application Priority Data

Dec. 19, 2016 (CN) ..... 201611175809.3
Dec. 19, 2016 (CN) ..... 201621393424.X

(51) Int. Cl.
*B05B 15/50* (2018.01)
*B05B 1/18* (2006.01)

(52) U.S. Cl.
CPC ..... *B05B 15/50* (2018.02); *B05B 1/18* (2013.01); *B05B 1/185* (2013.01)

(58) Field of Classification Search
CPC ..... B05B 15/50; B05B 1/18; B05B 1/185; B05B 1/3006
(Continued)

(56) References Cited

U.S. PATENT DOCUMENTS 8,205,812 B2 6/2012 Hester et al.
2015/0165451 A1 6/2015 Gopalan et al.

FOREIGN PATENT DOCUMENTS

CN 102366739 A 3/2012
CN 104096647 A 10/2014
CN 205341085 U 6/2016

*Primary Examiner* — Christopher S Kim
(74) *Attorney, Agent, or Firm* — Cooper Legal Group, LLC

(57) ABSTRACT

A showerhead including a connection base and a surface cover assembly, with a water outflow cavity formed therebetween. The surface cover assembly has a water discharging hole, and includes a surface cover body and a water outflow surface cover that are mounted and connected on the connection base. The water outflow surface cover has a water outflow hole, the lower periphery of which extends downward to form a water outflow port. The water outflow surface cover is attached against the upper face of the surface cover body, and the water outflow port passes through the surface cover body. The upper periphery of the water outflow hole extends upwards to form a water blocking peripheral wall. The showerhead also includes a valve that cooperates with the water discharge hole to close and open the water discharge hole when the water supply is on and off, respectively.

13 Claims, 6 Drawing Sheets

(58) Field of Classification Search
USPC ..... 239/110, 111, 106, 553, 572, 570
See application file for complete search history.

SHOWERHEAD CAPABLE OF DISCHARGING RESIDUAL WATER

FIELD OF THE DISCLOSURE

The invention relates to a showerhead, in particular to a showerhead capable of quickly discharging residual water.

BACKGROUND OF THE DISCLOSURE

Existing showerheads of discharging residual water, such as CN102366739A, which was first applied by applicant, include connection base, surface cover assembly and valve. The connection base and surface cover assembly are assembled together and formed a water outflow cavity between them. The surface cover assembly is provided with a water discharging hole and comprise a surface cover body and water outflow surface cover which are mounted and connected on the connection base; the water outflow surface cover is provided with a water outflow hole of which the top surface and bottom surface are in communication, the lower periphery of the water outflow hole extends downward to form a water outflow port, the water outflow surface cover is attached against the upper face of the surface cover body and the water outflow port passes through the surface cover body; the valve cooperates with the water discharging hole to close the discharging hole when the water is flowing, and open the water discharging hole when the water is off. In the process of discharging residual water, the residual water above the water outflow surface cover is discharged not only through the water discharging hole, but also through the water outflow port. Because the water outflow port has a smaller outlet section and has elasticity, the resistance is larger. Therefore, most of the water from the water outflow port is discharged by slow dropping, which leads to a long time of discharging residual water.

BRIEF SUMMARY OF THE DISCLOSURE

The present invention provides a showerhead capable of quickly discharging residual water, which overcomes the shortcomings of the showerhead of discharging residual water in background technology.

The technical scheme adopted by the invention to solve its technical problems is: A showerhead of quickly discharging residual water, comprising a connection base, a surface cover assembly and a valve, the connection base and the surface cover assembly are assembled together and formed a water outflow cavity between them, the surface cover assembly is provided with a water discharging hole and comprise a surface cover body and water outflow surface cover which are mounted and connected on the connection base; the water outflow surface cover is provided with a water outflow hole of which the top surface and bottom surface are in communication, the lower periphery of the water outflow hole extends downward to form a water outflow port, the water outflow surface cover is attached against the upper face of the surface cover body and the water outflow port passes through the surface cover body; the upper periphery of the water outflow hole extends upwards to form a water blocking peripheral wall; the valve cooperates with the water discharge hole so as to close the water discharge hole when the water supply is on and to open the water discharge hole when the water supply is off, when the water discharge hole is opened, the residual water in the water outflow cavity is discharged from the water discharge hole.

In an embodiment: the connection base is provided with an inlet waterway which can connect the external water supply source, and the inlet waterway can connect the water outflow cavity; the surface cover body is provided with a hole through the top and bottom surfaces, and the water outflow port adapts to go down through the hole of the surface cover body and extend below the surface cover body.

In an embodiment: the connection base is provided with a ventilation passage penetrating inside and outside.

In an embodiment: the connection base is provided with an aerator, and the ventilation passage is the suction passage of the aerator.

In an embodiment: the water discharging hole is located in the center of the surface cover assembly.

In an embodiment: the inlet of the water discharging hole is not higher than the top of the water outflow surface cover.

In an embodiment: the surface cover body is provided with the first through hole through the top and bottom surface, and the water outflow surface cover is provided with the second through hole through the top and bottom surface, the first through hole and the second through hole are matched and the water discharging hole includes the first through hole and the second through hole mentioned above.

In an embodiment: the top of the surface cover body is convexly provided with a convex ring wall, which surrounds the first through hole, the second through hole of the water outflow surface cover is adapted to fit outside the convex ring wall, and the top surface of the convex ring wall is not higher than that of the water outflow surface cover.

In an embodiment: the valve cooperates with the first through hole to control the opening and closing of the first through hole through the valve.

In an embodiment: the inner wall of the first through hole is provided with a large upper and lower tapered wall.

In an embodiment: the valve comprises a valve core, a valve stem fixed on the top of the valve core and an elastic body connecting the connection base and the valve stem, the valve core is connected to the connection base and can move between the upper and lower positions relative to the connection base: when the water is flowing, the hydraulic force acts on the valve to move the valve core from the upper position to the lower position, and the valve core cooperates with the water discharging hole to close the water discharging hole; when the water is closed, the elastic body acts on the valve stem to return the valve core to the upper position, and the valve core is away from the water discharging hole to open the water discharging hole.

In an embodiment: the center of the bottom surface of the valve core is fixed with a column rod and a plurality of water guide sheets fixed to the column rod, and the water guide sheets are also fixed to the bottom surface of the valve core, and the width of the water guide sheets to the bottom surface of the valve core is gradually reduced from the bottom end.

In an embodiment: the connection base is provided with an inlet waterway which can connect the external water supply source, and the inlet waterway can connect the water outflow cavity, and the water outlet of the inlet waterway extends inward into a supporting plate; the surface cover body is provided with a hole through the top and bottom surfaces, and the water outflow port adapts to go down through the hole of the surface cover body and extend below the surface cover body; the valve comprises a valve core, a valve stem fixed to the top surface of the valve core and an elastic body, the valve stem passes through the supporting plate from the bottom to the top and the upper end of the valve stem is fixed with a baffle, the elastic sleeves the valve stem and is supported between the baffle and the supporting plate, the valve core is connected to the connection base and can move between the upper position and the lower position relative to the connection base: when the water is flowing, the hydraulic force acts on the valve to move the valve core from the upper position to the lower position, and the valve core cooperates with the water discharging hole to close the water discharging hole; when the water is cut off, the elastic body acts on the valve stem to reset the valve core to the upper position, and the valve core is away from the water discharging hole to open the water discharging hole.

Compared with background technology, this technical scheme has the following advantages:

The upper edge of the water outlet extends upward to form a water blocking peripheral wall, when the water supply is off, the residual water on the water outflow surface cover cannot flow out from the water outflow port due to the blocking of the water blocking peripheral wall, and the residual water will quickly converge along the water outflow surface cover towards the water discharge hole and quickly discharge out from the water discharge hole, avoiding water dropping, such as quickly discharge within 10 seconds (traditional showerhead usually takes 30 seconds to 2 minutes), and it can be discharged clean. Second, it can avoid the water flowing out from the gap between the water outflow port and the surface cover body.

The connecting base is provided with a ventilation passage penetrating inside and outside, and the air enters the water outflow cavity, so that the air pressure in the showerhead cavity is balanced with the atmospheric pressure, so that the water quickly flows out from the middle water discharging hole under the action of gravity, and the dripping water can be quickly stopped after draining.

The connection base is provided with the aerator, the ventilation passage is the suction passage of the aerator. The suction passage is composed of the ventilation passage when the water is normally discharged, which can realize the function of aerated water, save water, and play the role of air pressure balance inside and outside the connecting cavity when the water is discharged.

The water inlet of the water discharging hole is not higher than the top surface of the water outflow surface cover, so that it can discharge quickly and discharge the residual water cleanly.

The top surface of the cover body is convexly provided with a convex ring wall surrounding the first through hole, and the second through hole of the water outflow cover is adapted to be connected outside the convex ring wall, and the top surface of the convex ring wall is not higher than the top of the water outflow cover surface, one, it can achieve rapid water discharging, and second, it is convenient to match the structure of the valve and the water discharging hole, the structure is simple, compact, and the performance is good. Thirdly, it is convenient to assemble surface cover body and water outflow surface cover.

The inner wall of the first through hole is provided with large upper and small lower tapered walls, the sealing performance between the valve and the water discharging hole is good, and the structure is simple and compact.

The valve core is connected to the connection base and the valve stem is connected to the inlet waterway of the connection base. It can discharge not only the water in the water cavity, but also the residual water between the showerhead switch and the water outflow cavity.

The center of valve core bottom is fixed with a column rod and a water guide sheet. The width of a water guide sheet decreases gradually from the bottom of the valve core to bottom, so as to guide water flow, make drainage gather, the appearance is beautiful and not easy to form water film.

BRIEF DESCRIPTION OF THE DRAWINGS

The present invention is further described below by means of drawings and specific embodiments.

DETAILED DESCRIPTION OF THE EMBODIMENTS

Figure 1:
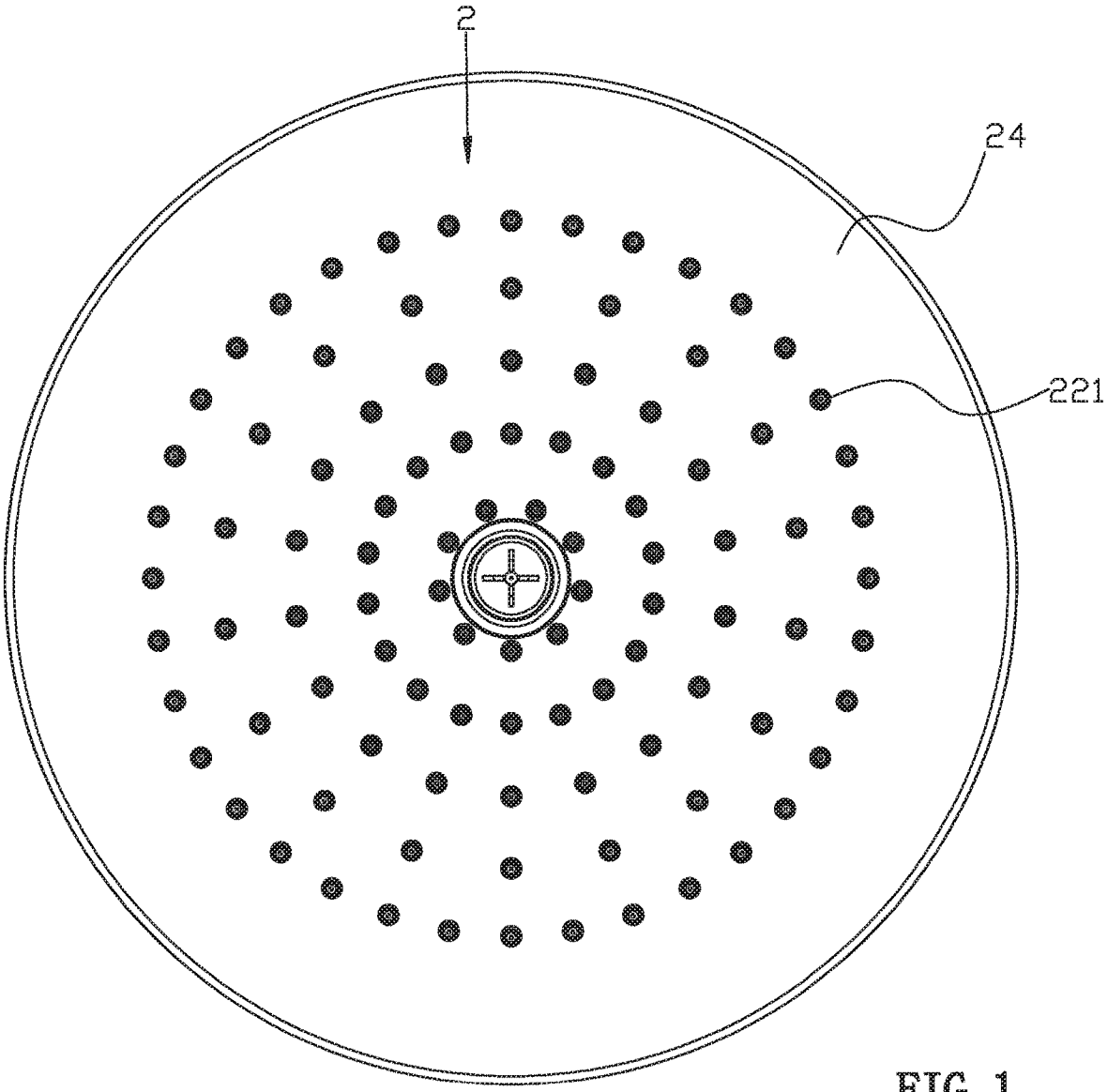
FIG. 1 is the bottom view of the showerhead of quickly discharging residual water according to the specific embodiment.
Figure 2:
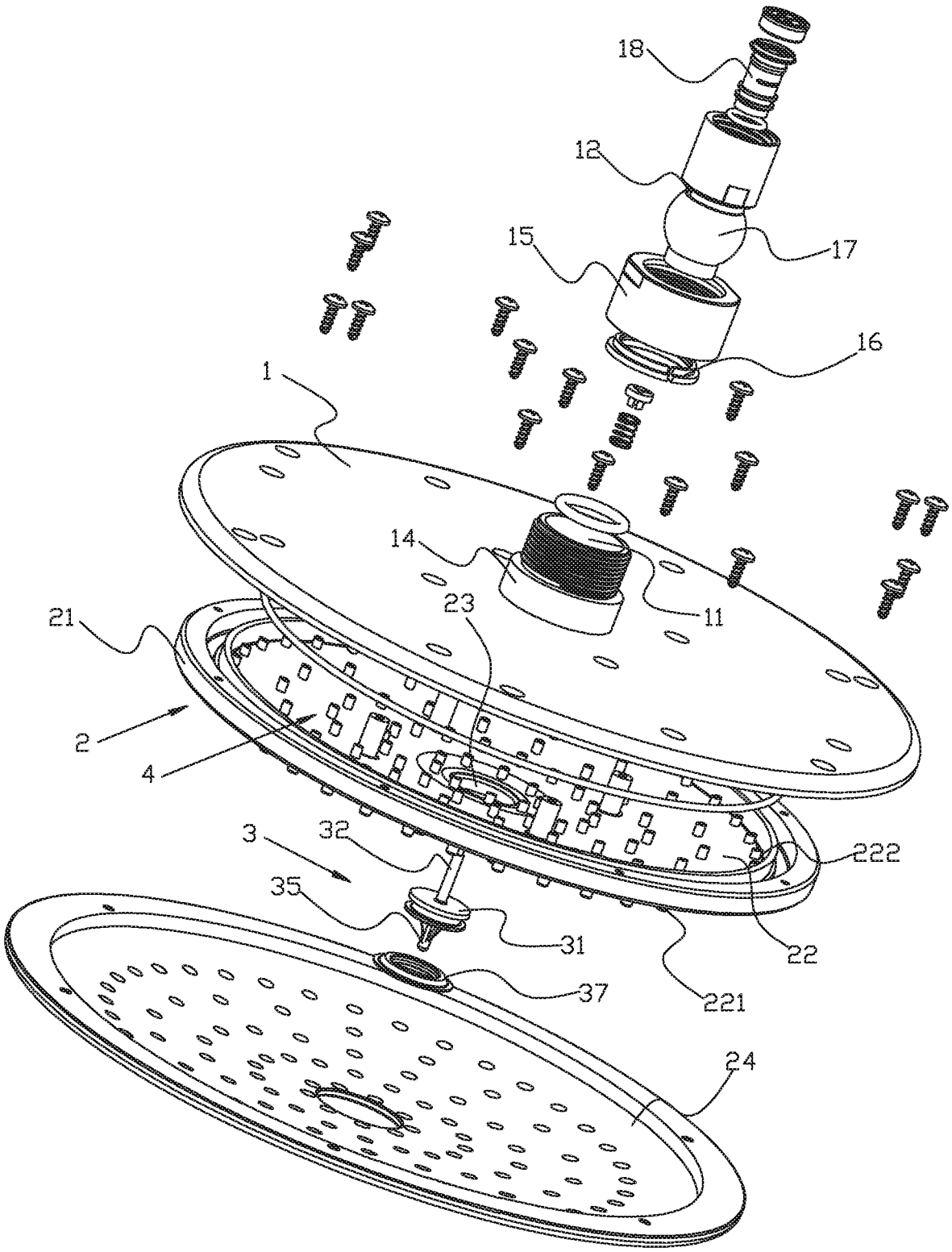
FIG. 2 is a three-dimensional decomposition diagram of the showerhead of quickly discharging residual water according to the specific embodiment.

Please refer to FIGS. 1 to 7, a showerhead capable of quickly discharging residual water, comprising a connection base 1, a surface cover assembly 2 and a valve 3.

The connection base 1 is provided with an inlet waterway 11 which can connect the external water supply source. The connection base 1 and the surface cover assembly 2 are mounted together, and there is a water outflow cavity 4 between them, such as fixed seal assembly, rotary seal assembly, swing seal assembly or sliding seal assembly, etc. In the figure, the fixed seal assembly is taken as an example. The inlet waterway 11 is connected to the water outflow cavity 4.

The surface cover assembly 2 is provided with water discharging hole 23 and includes a surface cover body 21 and a water outflow surface cover 22 mounted on the connection base 1. The mounting is fixedly sealed as described above. The surface cover body 21 is fabricated from hard materials, such as plastics, and the water outflow surface cover 22 is fabricated from silica gel. The surface cover body 21 is provided with a hole 211 through the bottom surface; the water outflow surface cover 22 is provided with water outflow hole runs through the top and bottom surface. The lower circumference of the water outflow hole extends downward to form a water outflow port 221, and the upper circumference of the water outflow hole extends upward to form a water blocking peripheral wall 222. The water outflow surface cover 22 is attached to the surface cover body 21 and the water outflow port 221 adapts downward through the hole 211 of the surface cover body 21 and extends below the surface cover body 21. The water outflow hole of the water outflow surface cover is provided with a water blocking peripheral wall 222. After the water is cut off, the residual water above the water outflow surface cover is blocked by the water blocking peripheral wall and cannot flow out from the water outflow port, and the residual water is discharged through the water discharging hole, because the water discharge area of the water discharging hole is relatively large enough to speed up the discharge, and avoid the slow dropping.

The water discharging hole 23 is located in the center of surface cover assembly 2, and the water inlet of the water discharging hole 23 is not higher than the top of the water outflow surface cover 22, so that the water above the water outflow surface cover 22 can be quickly discharged through the water discharging hole 23 to avoid the occurrence of residual water. The specific structure of the water discharging hole 23 is as follows: The surface cover body 21 is provided with the first through hole 212 running through the top and bottom, the water outflow surface cover 22 is provided with the second through hole 223 running through the top and bottom. The first through hole 212 and the second through hole 223 are matched and the water discharging hole 23 includes the first through hole 212 and the second through hole 223 mentioned above. Best of all, the top of the surface cover body 21 is convexly provided with a convex ring wall 213, which surrounds the first through hole 212, the second through hole 223 of the water outflow surface cover 22 is adapted to fit outside the convex ring wall 213, and the top surface of the convex ring wall 213 is not higher than that of the water outflow surface cover 22, it is convenient to assemble the water outflow surface cover and the surface cover body, and it is convenient to cooperate with the valve to control the water discharging hole to open and close.

The valve 3 and the water discharging hole 23 are combined to close the water discharging hole 23 when the water is flowing and open the water discharging hole 23 when the water is cut off. When the water discharging hole 23 is opened, the residual water in the water outflow cavity 4 is discharged from the water discharging hole 23. In this embodiment, the valve 3 and the first through hole 212 cooperate to control the opening and closing of the first through hole 212 through the valve 3. For example, the inner wall of the first through hole 212 is provided with a large upper and small lower tapered wall 214, through the valve 3 to achieve sealing by the tapered wall, through the valve away from the tapered wall to open. In specific structures: The water outflow of the inlet waterway 11 extends inward to form a supporting plate 13; the valve 3 includes a valve core 31, a valve stem 32 fixed on the top of the valve core 31 and an elastic body 33. The valve stem 32 passes through the supporting plate 13 from bottom to top and the upper end of the valve stem 32 is fixed with a baffle 34. The elastic body 33 sleeves the valve stem 32 and is supported between the baffle 34 and the supporting plate 13. The valve core 31 is connected to the connection base 1 and can move from the upper position to the lower position relative to connection base 1. The water force acts on the valve core 31 to move the valve core 31 from the upper position to the lower position when the water is opened, while the elastic body 33 acts on the valve stem 32 to reset the valve core 31 to the top when the water is cut off. When the valve core 31 is in the upper position, the valve core 31 is away from the water discharging hole 23 to open the water discharging hole 23, and when the valve core 31 is in the lower position, the valve core 31 cooperate with the water discharging hole 23 to close the water discharging hole 23. The center of the bottom surface of the valve core 31 is fixed with a column rod 35 and a plurality of water guide sheets 36 fixed to the column rod 35. The water guide sheets 36 are also fixed to the bottom surface of the valve core 31. The width of the bottom surface of the water guide sheets 36 from the bottom of the valve core 31 are gradually reduced, and the side wall of the water guide sheets 36 away from the column rod 35 are a curved wall.

According to the need, the connection base 1 is provided with a ventilation passage 12 run through inside and outside of the connection base 1. The connection base is provided with an aerator, and the ventilation passage 12 is the suction passage of the aerator. In this embodiment, the connection base 1 is convexly provided with a connection ring wall 14 surrounding the inlet waterway. The connection ring wall 14 can be assembled and fixed with a fixed joint 15 and a bushing 16. Through cooperation of the bushing 16, the connection ring wall 14 and the fixed joint 15, a spherical joint 17 is connected. The spherical joint 17 is provided with an inner sleeve 18, and the aerator is arranged in spherical joint 17 and inner sleeve 18.

According to need, the surface cover assembly 2 can also include a decorative cover 24, which is provided with a first through hole aligned to the hole 211, is provided with a second through hole corresponding to the first through hole, and the water outflow port also passes through the first through hole. The discharging hole also a second though hole.

According to need, in order to enhance the sealing performance, it is preferable that the valve core casing is provided with a sealing ring 37, such as a y-ring, and the y-ring and the water discharging hole are in contact with each other to achieve sealing.

Figure 3:
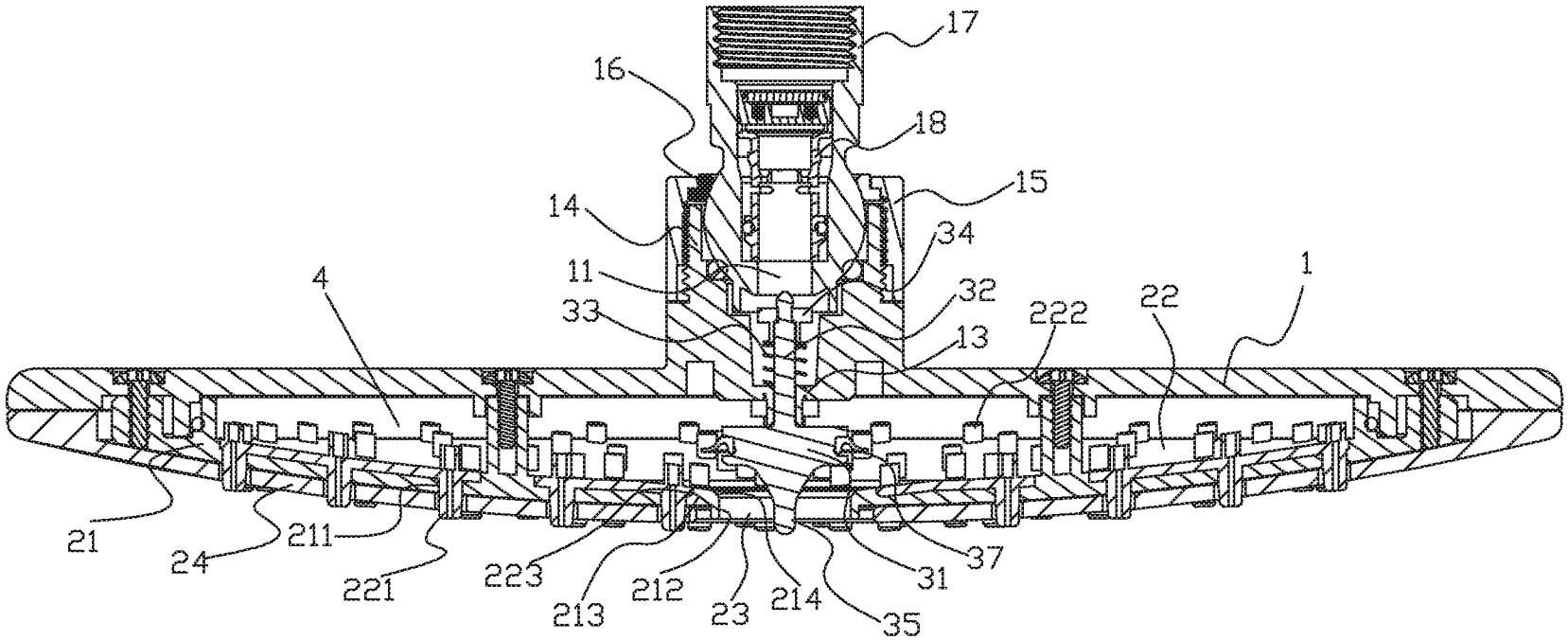
FIG. 3 is a cross-sectional view of the showerhead of quickly discharging residual water when the water is closed in the specific embodiment.
Figure 4:
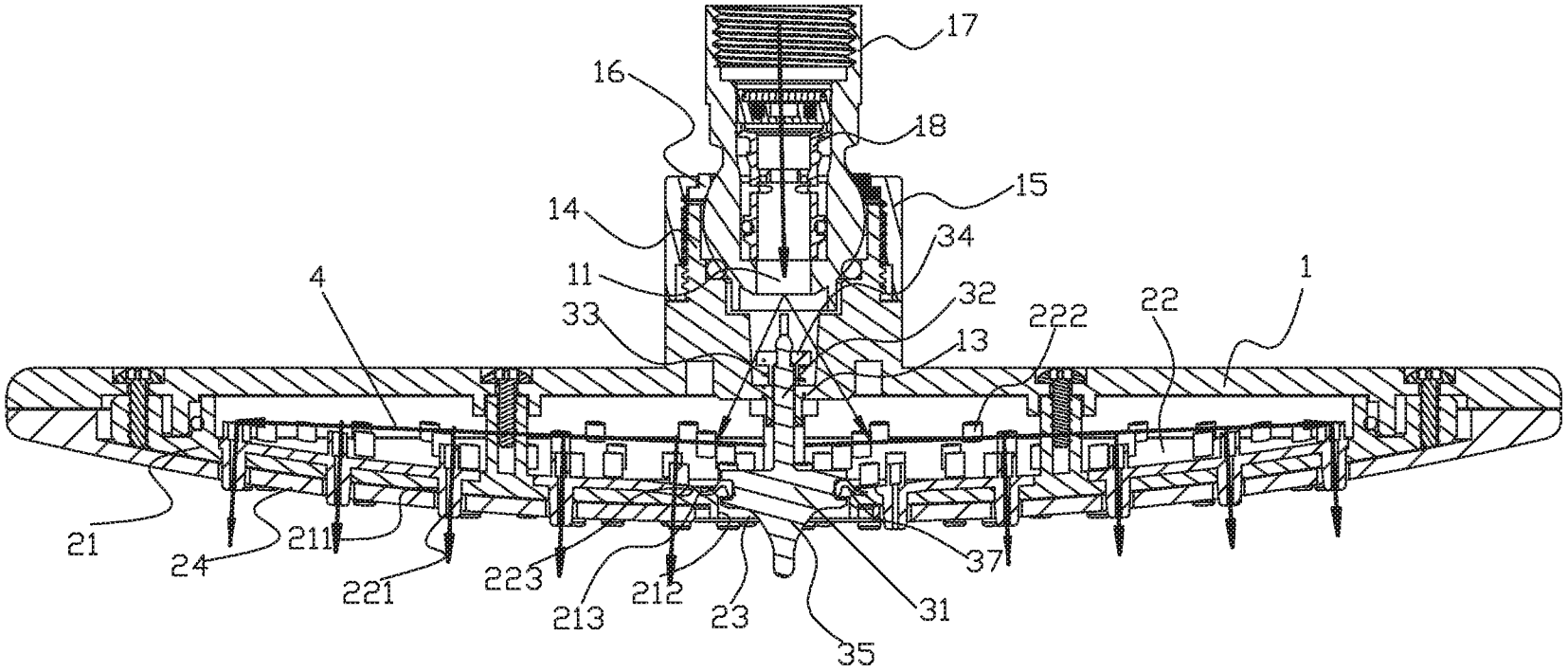
FIG. 4 is a cross-sectional view of the showerhead of quickly discharging residual water when the water is flowing in the specific embodiment, the arrows in the figure indicate the flow.
Figure 5:
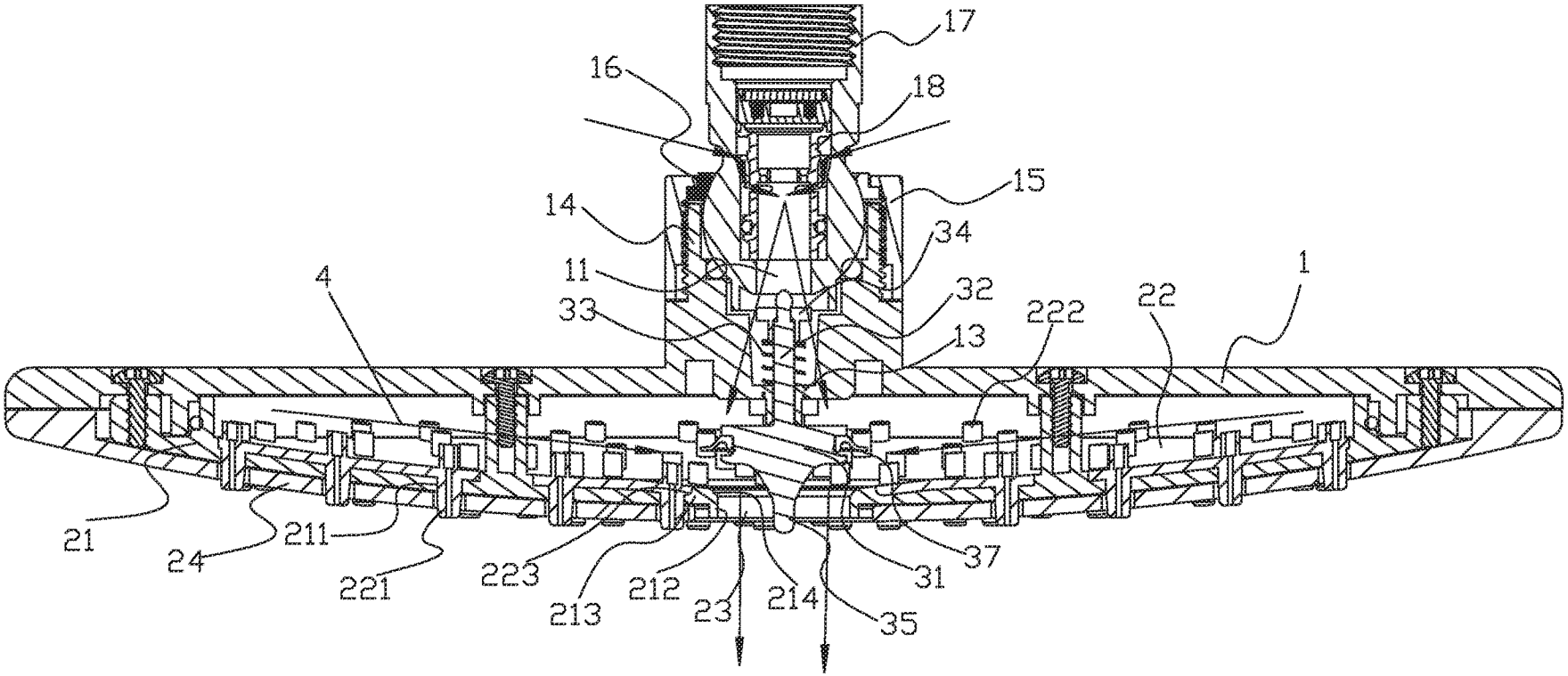
FIG. 5 is a cross-sectional view of the showerhead of quickly discharging residual water when the water is cut off, some arrows in the figure indicate water flow and some arrows indicate air flow.
Figure 6:
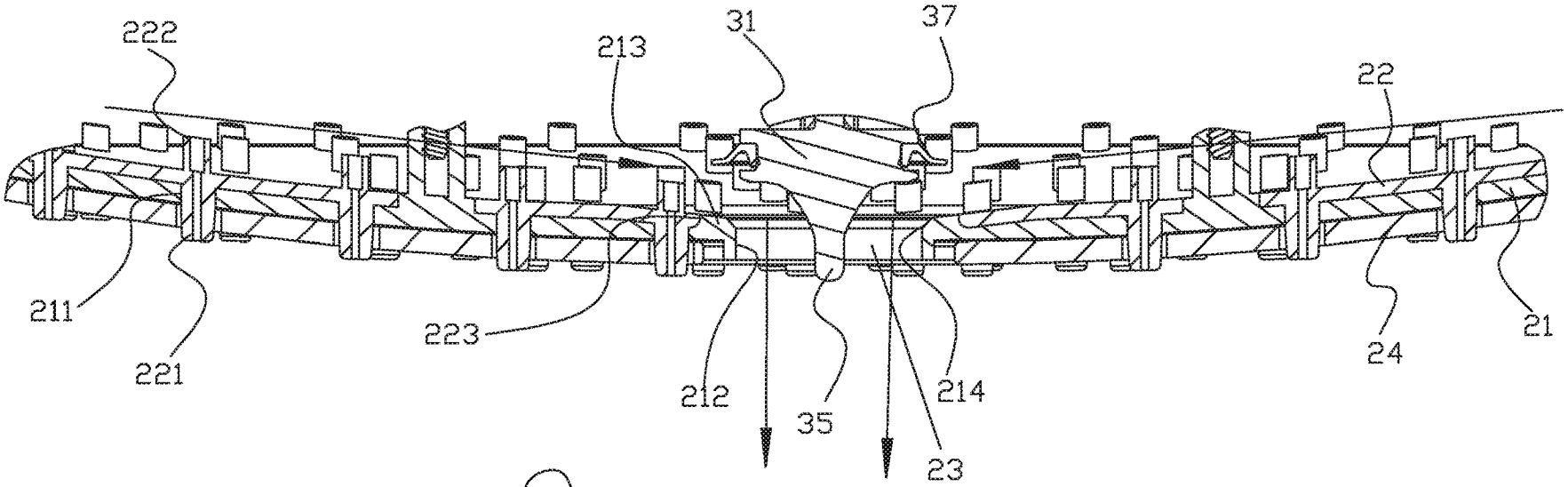
FIG. 6 is a partial enlargement diagram of FIG. 5.
Figure 7:
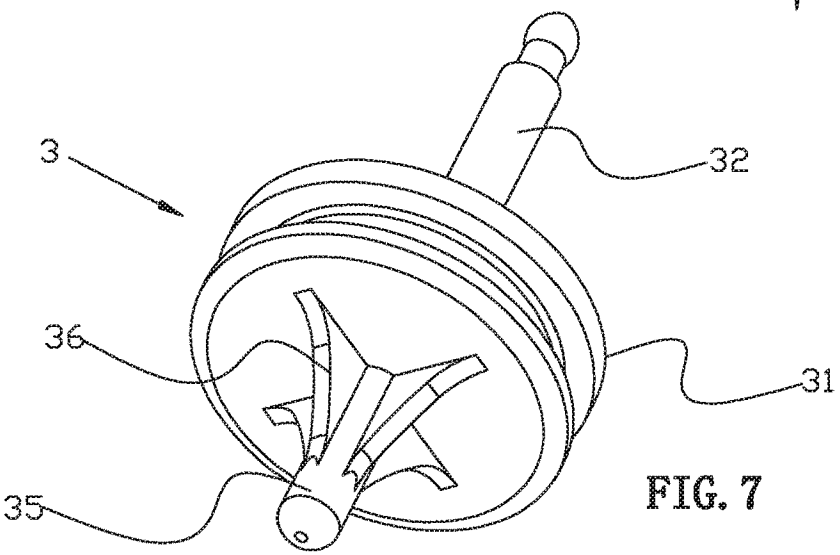
FIG. 7 is a three-dimensional schematic diagram of the valve core of the showerhead of quickly discharging residual water in the specific embodiment.

As shown in FIG. 3, in the initial state, the showerhead has no water supply, the valve core 31 is in the upper position under the action of elastic body 33 such as spring, the valve core is far away from the water discharging hole, and the water discharging hole is open. As shown in FIG. 4, the valve core 31 moves downward to the lower position under the action of water pressure. The elastic body is in the state of compressed energy storage. The valve core contacts with the tapered wall of the water discharging hole to seal. The water discharging hole is closed. The water outflow cavity is filled with water, and the water is normally discharged from the water outflow port. As shown in FIG. 5, after water shutdown, the hydraulic pressure is eliminated or reduced, the energy storage of elastic body is released, the valve core restores to its initial state under the action of elastic body, that is, it is in the upper position, and the water is discharged from the water discharging hole. Moreover, an air ventilation passage is provided, air enters the outlet cavity, which makes the pressure in showerhead cavity keep balance with the atmospheric pressure, and water rapidly flows out from the middle water discharging hole under the action of gravity. It can stop dripping quickly after drainage.

As mentioned above, it is only a better embodiment of the present invention, so the scope of embodiment of the present invention cannot be limited accordingly. That is, the equivalent changes and modifications made according to the patent scope and description content of the present invention should still be within the scope of the present invention.

INDUSTRIAL APPLICABILITY

The invention provides a showerhead capable of quickly discharging residual water, when the water supply is off, the residual water on the water outflow surface cover cannot flow out from the water outflow port due to the blocking of the water blocking peripheral wall, and the residual water will quickly converge along the water outflow surface cover towards the water discharge hole and quickly discharge out from the water discharge hole, avoiding water dropping. The design of the invention is ingenious, and the application range is wide, has good industrial practicability.

The invention claimed is:

1. A showerhead capable of discharging residual water, comprising:

a connection base, a surface cover assembly, and a valve, wherein:

the connection base is connected to the surface cover assembly to form a water outflow cavity between the connection base and the surface cover assembly, the surface cover assembly comprises a water discharging hole, a surface cover body, and a water outflow surface cover, the surface cover body and the water outflow surface cover are connected to the connection base, the water outflow surface cover comprises a water outflow hole passing through a top surface and a bottom surface of the water outflow surface cover, a lower periphery of the water outflow hole extends downward to form a water outflow port, the water outflow surface cover abuts a top surface of the surface cover body, and the water outflow port passes through the surface cover body, an upper periphery of the water outflow hole extends upward to form a water blocking peripheral wall, the valve cooperates with the water discharging hole, when water flows into the water outflow hole:

a hydraulic force of the water acts on the valve to enable the valve to move downward to close the water discharging hole, and when the water does not flow into the water outflow hole:

an elastic body acts on the valve to enable the valve to move upward to open the water discharging hole, and residual water in the water outflow cavity is discharged from the water discharging hole.

2. The showerhead capable of discharging residual water according to claim 1, wherein:

the connection base is disposed with an inlet waterway configured to connect to an external water supply source, the inlet waterway is connected to the water outflow cavity, the surface cover body comprises hole passing through the top surface and a bottom surface of the surface cover body, and the water outflow port cooperates with the hole of the surface cover body and extends to a lower side of the surface cover body.

3. The showerhead capable of discharging residual water according to claim 1, wherein the connection base is disposed with a ventilation passage passing through an inner side and an outer side of the connection base.

4. The showerhead capable of discharging residual water according to claim 3, wherein:

the connection base is disposed with an aerator, and the ventilation passage defines a suction passage of the aerator.

5. The showerhead capable of discharging residual water according to claim 1, wherein the water discharging hole is disposed at a center of the surface cover assembly.

6. The showerhead capable of discharging residual water according to claim 1, wherein an inlet of the water discharging hole is not higher than the top surface of the water outflow surface cover.

7. The showerhead capable of discharging residual water according to claim 1, wherein:

the surface cover body comprises a first through hole passing through the top surface and a bottom surface of the surface cover body, the water outflow surface cover comprises a second through hole, passing through the top surface and the bottom surface of the water outflow surface cover, the first through hole cooperates with the second through hole, and the water discharging hole comprises the first through hole and the second through hole.

8. The showerhead capable of discharging residual water according to claim 7, wherein:

the top surface of the surface cover body is convex to define a convex ring wall configured to surround the first through hole, the second through hole of the water outflow surface cover is coupled to and surrounds an outer side of the convex ring wall, and a top surface of the convex ring wall is not higher than the top surface of the water outflow surface cover.

9. The showerhead capable of discharging residual water according to claim 8, wherein:

an inner wall of the first through hole is tapered such that an upper end of the inner wall is larger than a lower end of the inner wall.

10. The showerhead capable of discharging residual water according to claim 7, wherein the valve cooperates with the first through hole to enable the valve to control the first through hole to be opened and to be closed.

11. The showerhead capable of discharging residual water according to claim 1, wherein:

the valve comprises a valve core, a valve stem fixed to a top of the valve core, and the elastic body connected to the connection base and the valve stem, the valve core is connected to the connection base and is configured to move between an upper position and a lower position relative to the connection-base, when the water flows into the water outflow hole:

the hydraulic force of the water acts on the valve core to enable the valve core to move from the upper position to the lower position, and the valve core cooperates with the water discharging hole to close the water discharging hole, and when the water does not flow into the water outflow hole:

the elastic body acts on the valve stem to enable the valve core to be reset to the upper position, and the valve core moves away from the water discharging hole to open the water discharging hole.

12. The showerhead capable of discharging residual water according to claim 11, wherein:

a center of a bottom surface of the valve core is fixed with a column rod and a plurality of water guide sheets fixed to the column rod, the plurality of water guide sheets are fixed to the bottom surface of the valve core, and a width of each of the plurality of water guide sheets of the valve core decreases is gradually from a bottom end of each of the plurality of water guide sheets to the bottom surface of the valve core.

13. The showerhead capable of discharging residual water according to claim 1, wherein:

the connection base is disposed with an inlet waterway configured to be connected to an external water supply source, the inlet waterway is connected to the water outflow cavity, a water outlet of the inlet waterway extends inward to define a supporting plate, the surface cover body comprises a hole passing through the top surface and a bottom surface of the surface cover body, the water outflow port cooperates with the hole of the surface cover body and extends to a lower side of the surface cover body, the valve comprises a valve core, a valve stem fixed to a top of the valve core, and the elastic body, the valve stem passes upward through the supporting plate, an upper end of the valve stem is fixed with a baffle, the elastic body surrounds the valve stem, the elastic body is disposed between and abuts the baffle and the supporting plate, the valve core is connected to the connection base and is configured to move between an upper position and a lower position relative to the connection base, when the water flows into the water outflow hole:

the hydraulic force of the water acts on the valve core to enable the valve core to move from the upper position to the lower position, and the valve core cooperates with the water discharging hole to close the water discharging hole, and when the water does not flow into the water outflow hole:

the elastic body acts on the valve stem to enable the valve core to be reset to the upper position, and the valve core moves is away from the water discharging hole to open the water discharging hole.

* * * * *